US010047745B2

(12) United States Patent
Tamura

(10) Patent No.: US 10,047,745 B2
(45) Date of Patent: Aug. 14, 2018

(54) ELECTRIC OIL PUMP

(71) Applicant: Hitachi Automotive Systems, Ltd., Hitachinaka-shi, Ibaraki (JP)

(72) Inventor: Eiji Tamura, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/021,093

(22) PCT Filed: May 26, 2015

(86) PCT No.: PCT/JP2015/065003
§ 371 (c)(1),
(2) Date: Mar. 10, 2016

(87) PCT Pub. No.: WO2016/035398
PCT Pub. Date: Mar. 10, 2016

(65) Prior Publication Data

US 2016/0215776 A1 Jul. 28, 2016

(30) Foreign Application Priority Data

Sep. 3, 2014 (JP) ..... 2014-178627

(51) Int. Cl.
*F04C 2/10* (2006.01)
*F04C 15/00* (2006.01)
*F04C 2/18* (2006.01)

(52) U.S. Cl.
CPC ..... *F04C 15/008* (2013.01); *F04C 2/102* (2013.01); *F04C 2/18* (2013.01); *F04C 15/0061* (2013.01);
(Continued)

(58) Field of Classification Search
CPC ..... F04C 2/102; F04C 2/18; F04C 15/0061; F04C 15/008; F04C 2270/125;
(Continued)

(56) References Cited

U.S. PATENT DOCUMENTS 6,323,613 B1 * 11/2001 Hara ..... B60K 6/26 165/299
2010/0290934 A1 * 11/2010 Hadar ..... F04B 17/03 417/410.4
(Continued)

FOREIGN PATENT DOCUMENTS

JP 2012-207638 A 10/2012
JP 2013-96283 A 5/2013
(Continued)

OTHER PUBLICATIONS

International Search Report (PCT/ISA/210) issued in PCT Application No. PCT/JP2015/065003 dated Aug. 11, 2015 with English-language translation (two (2) pages).
(Continued)

*Primary Examiner* — Dominick L Plakkoottam
*Assistant Examiner* — Philip Stimpert
(74) *Attorney, Agent, or Firm* — Crowell & Moring LLP

(57) ABSTRACT

Provided is a configuration where a stator section is fastened to an electric motor part-accommodating portion at a location where an end surface of the stator section projects outwardly from an end plane of an opening of an electric motor part-accommodating portion thereby bringing the center of gravity of an electric motor part closer to the end plane of the opening of the electric motor part-accommodating portion. With this, the center of gravity of the electric motor part is brought closer to the end plane of the opening of the electric motor part-accommodating portion so as to make a rotor section difficult to receive the influence of
(Continued)

oscillations, and consequently a phenomenon where the rotor section is shaken under the influence of oscillations can be restrained.

3 Claims, 1 Drawing Sheet

(52) U.S. Cl.
CPC ..... *F04C 2210/14* (2013.01); *F04C 2240/30* (2013.01); *F04C 2270/125* (2013.01)

(58) Field of Classification Search
CPC ..... F04C 2240/30; F04C 2240/40; F04C 2210/206; F04C 2210/14; F04C 2/10; F04D 29/406
See application file for complete search history.

(56) References Cited

U.S. PATENT DOCUMENTS

2012/0128513 A1* 5/2012 Sakata ..... F04C 2/086 417/410.1
2013/0071267 A1* 3/2013 Miyaki ..... F04C 2/10 417/410.1
2014/0079578 A1* 3/2014 Irie ..... F04D 13/06 417/423.14

FOREIGN PATENT DOCUMENTS

JP 2013-122251 A 6/2013
JP 2013122251 A * 6/2013
JP 2013-150520 A 8/2013

OTHER PUBLICATIONS

Japanese-language Written Opinion (PCT/ISA/237) issued in PCT Application No. PCT/JP2015/065003 dated Aug. 11, 2015 (three (3) pages).

* cited by examiner

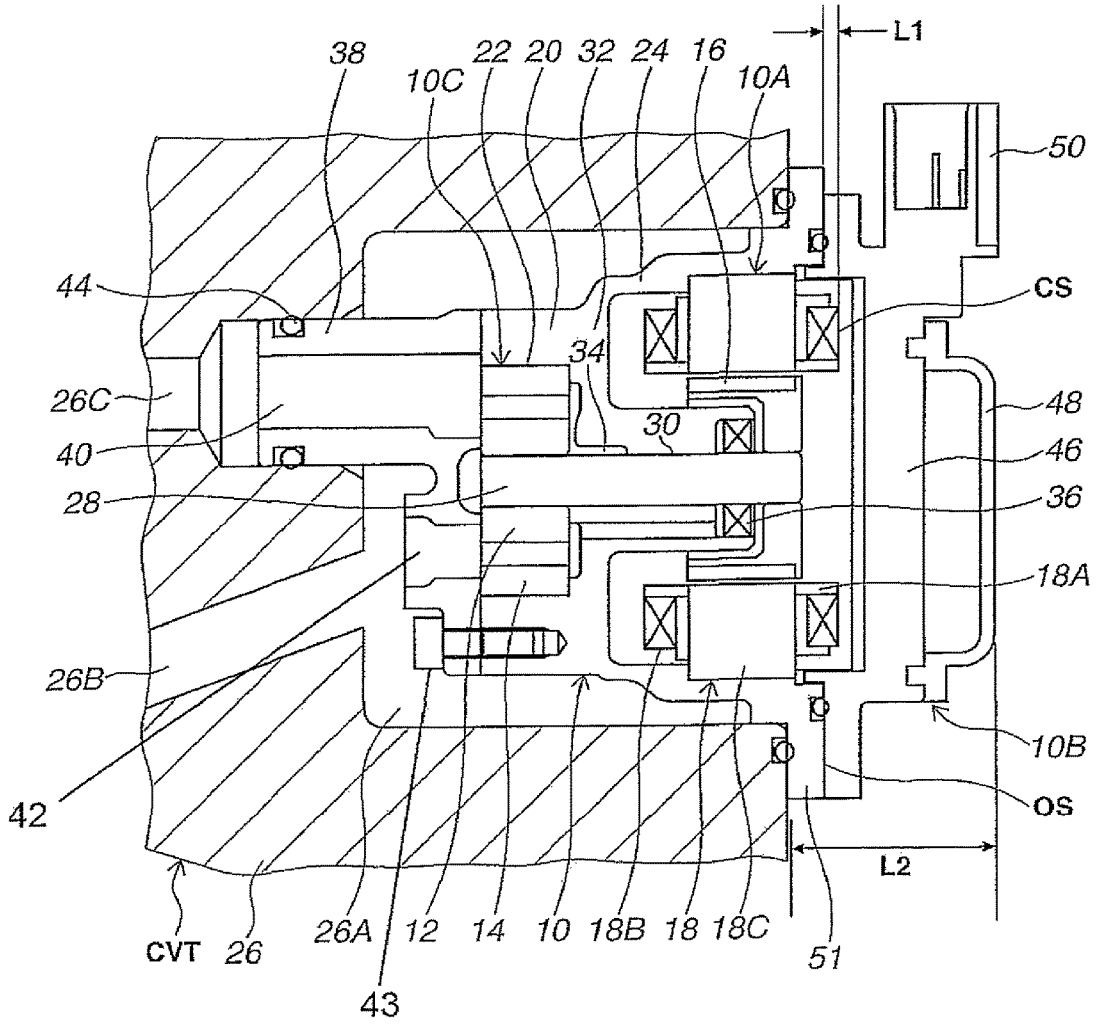
L1
38
22
20
32
24
16
10C
10A
50
44
CS
34
26C
48
30
40
46
28
36
18A
26B
10B
42
OS
L2
CVT
26
26A
12
14
10
18B
18
18C
51
43

ELECTRIC OIL PUMP

TECHNICAL FIELD

The present invention relates to an electric oil pump, and more particularly to an electric oil pump to be combined with an automatic transmission of an automotive vehicle.

BACKGROUND OF THE INVENTION

In recent years, commercialization of automotive vehicles or hybrid vehicles having an idle stop function has been developed as the demand for improved fuel economy increases. In these vehicles, pumps driven by an internal combustion engine are to stop at the time when the internal combustion engine is stopped, and therefore the presence of a pump-driving source other than the internal combustion engine has been needed. In particular, automotive vehicles, hybrid vehicles and the like having an idle stop function require an oil pump so that a hydraulic mechanism for controlling an automatic transmission can keep ensuring a hydraulic pressure. In view of the above, there has been developed the trend toward the increase of the use of an electric oil pump which imparts a rotational force to a pump rotor by using an electric motor to cause pumping actions.

As an electric oil pump mounted to an automatic transmission of an automotive vehicle, there has widely been adopted an internal gear pump of a trochoid type. In an internal gear pump, a pump rotor is rotated by a driving rotational shaft driven by a motor, so that an outer rotor having an inner tooth engageable with an outer tooth of the pump rotor is rotated. With this, the volume of a plurality of volume chambers formed between the inner tooth of the outer rotor and the outer tooth of the pump rotor is continuously changed thereby performing intake/discharge of a hydraulic oil. Such an internal gear pump is disclosed in Japanese Patent Application Publication No. 2012-207638 (Patent Document 1) for example.

A typical electric oil pump is provided including: a drive control part for controlling the passage of electric current through an electric motor; a stator section having a wire and an iron core for generating magnetomotive force by the electric current passage from the drive control part; a rotor section disposed in a space defined by the inner periphery of the stator section and having a permanent magnet to be rotated by the magnetomotive force; a driving rotational shaft fixed to the rotor section by means of press-fitting or the like so as to rotate together therewith; and a pump rotor section fixed to the driving rotational shaft by means of press-fitting or the like so as to rotate together with the driving rotational shaft. Incidentally, the stator section and the rotor section are parts constituting an electric motor.

REFERENCES ABOUT PRIOR ART

Patent Documents

Patent Document 1: Japanese Patent Application Publication No. 2012-207638

SUMMARY OF THE INVENTION

By the way, in the electric oil pump disclosed in Patent Document 1, a stator section which constitutes an electric motor part is accommodated or disposed inside the end plane defining an opening of an electric motor part-accommodating portion formed in a pump housing, with which a rotor section also constituting the electric motor part is disposed further inside the end plane defining the opening of the electric motor part-accommodating portion. Accordingly, the center of gravity of the electric motor as a whole resides in the recesses of the electric motor part-accommodating portion.

This electric oil pump is housed in a pump-accepting section formed in an automatic transmission casing. In this case, fixing of the electric oil pump to the automatic transmission casing is achieved by fastening the electric oil pump to the automatic transmission casing with a bolt through a fastening bracket formed at the pump housing of the electric oil pump. More specifically, the fastening bracket radially outwardly extending from the end plane of the opening of the electric motor part-accommodating portion of the pump housing is formed having a hole into which a fastening bolt is to be inserted. When the fastening bolt is screwed into the automatic transmission casing through this hole, the electric oil pump is adapted to be securely fixed onto the automatic transmission casing. Thus, an electric oil pump-fixing section is on the same plane as the end plane of the opening of the electric motor part-accommodating portion.

In such an arrangement, if the center of gravity of the electric motor resides in the recesses of the electric motor part-accommodating portion of the pump housing as mentioned above, the distance between a plane extending along the section at which the fastening bracket that the pump housing has is fixed to the casing and the center of gravity of the electric motor residing on a line perpendicular thereto becomes increased. Consequently, in an environment (e.g. in an environment of an automotive vehicle) often causing oscillation-accompanying traveling and engine vibrations, an electric motor the center of gravity of which is far from the fixing section (or the end plane of the opening) is susceptible to the effect of the oscillations and tends to cause a phenomenon in which the rotor section in particular is shaken by the oscillations. The thus shaken rotor section brings about some adverse effects such as an abnormal wear of a bearing of a driving rotational shaft which connects the pump rotor to the rotor section, and as a result the driving rotational shaft gets inclined to cause undesired sounds and so forth.

An object of the present invention is to provide a novel electric oil pump which can restrain a phenomenon where the rotor section is shaken under the influence of oscillations.

The present invention is characterized by securing a stator section to an electric motor part-accommodating portion at a location where an end surface of the stator section projects outwardly from an end plane of an opening of an electric motor part-accommodating portion thereby bringing the center of gravity of an electric motor part closer to the end plane of the opening of the electric motor part-accommodating portion.

According to the present invention, the center of gravity of an electric motor part is brought closer to the end plane of the opening of the electric motor part-accommodating portion. With this, the rotor section becomes difficult to receive the influence of oscillations, and consequently a phenomenon where the rotor section is shaken under the influence of oscillations can be restrained.

BRIEF DESCRIPTION OF THE DRAWINGS

FIG. 1 A longitudinal sectional view of an electric oil pump to which the present invention is applied.

MODE(S) FOR CARRYING OUT THE INVENTION

Referring now to the accompanying drawings, an embodiment of the present invention will specifically be explained; however, the present invention is not limited to the illustrated embodiment, and modifications and variations of the illustrated embodiment will occur to those skilled in the art in light of the above teachings.

An embodiment of an electric oil pump according to the present invention, which is to be combined with an automatic transmission, will hereinafter be discussed by reference to the accompanying drawings. The electric oil pump is an oil pump to be mounded for automatic transmission of a vehicle having an idle stop function, for example. The automatic transmission refers to a belt-type continuously variable transmission and equipped separately with a mechanical pump driven by an engine. Although an electric oil pump can be fixed to various pump-fixing devices as mentioned above, an electric oil pump of the present embodiment is used as a hydraulic pressure supply source for automatic transmission and therefore fixed to an automatic transmission casing.

At the time of stopping the engine under an idle stop control, the mechanical pump cannot ensure a hydraulic pressure. Additionally, if a hydraulic pressure is reduced by, for example, a leak from a friction fastening element or a pulley in the belt-type CVT, a certain period of time is required for ensuring a hydraulic pressure necessary for a restart so as to cause a drivability deterioration. In view of the above, an electric oil pump capable of discharging a hydraulic pressure regardless of the running state of the engine is provided in addition to the mechanical pump to ensure such an amount of a hydraulic pressure as to compensate for the leak from the friction fastening element or the pulley, thereby improving the drivability at the time of running the engine and at the time of restarting the vehicle. Incidentally, the automatic transmission may be a stepped variable transmission other than the belt-type continuously variable transmission.

Referring now to FIG. 1, a structure of electric oil pump 10 in the state of being fixed to an automatic transmission casing will be explained in detail.

Electric oil pump 10 is constructed from electric motor part 10A, terminal casing part 10B fixed adjacent to electric motor part 10A, and pump part 10C driven by electric motor part 10A. Electric motor part 10A is provided including at least rotor section 16 and stator section 18. This electric motor part 10A is enclosed in electric motor part-accommodating portion 24 provided to one side of metal pump housing 20 formed of aluminum alloy or the like.

Additionally, the above-mentioned pump housing 20 is formed having, at the other side, pump part-accommodating portion 22 which can accommodate pump part 10C. Pump part 10C is composed of at least pump rotor 12 having an external gear, and outer rotor 14 having an internal gear. Pump rotor 12 and outer rotor 14 are housed in the above-mentioned pump part-accommodating portion 22 provided at the other side of pump housing 20. Terminal casing part 10B is constituted of terminal casing 46 fixed to pump housing 20 and formed of synthetic resin, and terminal cover 48 formed of synthetic resin and provided to envelop a terminal-forming member (not shown but housed in the terminal casing 46 to be molded integral therewith).

Electric oil pump 10 is fixed to automatic transmission casing 26. Automatic transmission casing 26 is formed to have pump-receiving section 26A. Pump-receiving section 26A is provided with inflow passage 26B and outflow passage 26C for hydraulic oil. Electric oil pump 10 is accommodated in pump-receiving section 26A and fastened to casing 26 with a fastening bolt or the like. When electric oil pump 10 is operated, hydraulic oil is introduced through inflow passage 26B and discharged through outflow passage 26C.

A space defined by the inner peripheral surface of the pump-receiving section 26A and the outer peripheral surface of the pump housing 20 of electric oil pump 10 is filled with hydraulic oil. This hydraulic oil is to be drawn by electric oil pump 10 and discharged through outflow passage 26C. Therefore, the hydraulic oil is brought into thermal contact with the outer peripheral surface of pump housing 20 of electric oil pump 10 to seize heat from the outer peripheral surface of pump housing 20 thereby cooling electric oil pump 10.

Electric oil pump 10 is provided to include: pump part 10C composed of pump rotor 12 having an external gear and outer rotor 14 having an internal gear; and electric motor part 10A composed of rotor section 16 joined with pump rotor 12 and stator section 18. Stator section 18 is configured to include wire 18B wound around bobbin 18A, and iron core 18C establishing a magnetic circuit together with wire 18B. This wire 18B is drawn from electric motor part 10A into terminal casing part 10B.

The above-mentioned pump part 10C and electric motor part 10A are housed in pump part-accommodating portion 22 provided at one end surface of pump housing 20 and electric motor part-accommodating portion 24 provided at the other end surface. More specifically, the pump housing 20 is formed having: pump part-accommodating portion 22 which can rotatably accommodate outer rotor 14 therein at the side of the one end surface of pump housing 20; and electric motor part-accommodating portion 24 which can fix and support stator section 18 at its inner periphery side and at its opening defined at the other end surface while accommodating rotor section 16 and the like therein.

Furthermore, pump housing 20 is formed integral with fastening bracket 51 radially outwardly from an end plane of an opening of electric motor part-accommodating portion 24. This fastening bracket 51 has the function of fastening the electric oil pump to automatic transmission casing 26. Additionally, the end plane of the opening of electric motor part-accommodating portion 24 is adapted to open on the same plane as outer end surface OS of fastening bracket 51.

Fastening bracket 51 formed on the end plane of the opening of electric motor part-accommodating portion 24 of pump housing 20 is provided having a hole for inserting a fastening bolt thereinto, so as to be secured to automatic transmission casing 26 with a fastening bolt (not shown). Though not shown, a similarly constructed fastening bracket 51 is formed also at two other positions so as to secure electric oil pump 10 to casing 26 with the similar arrangement.

Inside pump housing 20, there is provided a plain bearing portion 30 for rotatably supporting driving rotational shaft 28 which connects pump rotor 12 to rotor section 16. This plain bearing portion 30 takes on such an arrangement that the inner peripheral surface thereof rotatably supports the outer peripheral surface of the medial region of driving rotational shaft 28.

Moreover, plain bearing portion 30 is formed at bulkhead 32 provided for dividing pump part-accommodating portion 22 and electric motor part-accommodating portion 24 from each other. This plain bearing portion 30 is formed having a certain length of crevice between its inner peripheral surface and the outer peripheral surface of driving rotational shaft 28. An oil on the discharge side or the higher pressure side is adapted to be introduced into this crevice through oil introduction passage 34. Furthermore, seal member 36 for sealing driving rotational shaft 28 is provided on the upper side of driving rotational shaft 28 and plain bearing portion 30.

Pump cover 38 is provided with: discharge port 40 cylindrically prolonged to communicate with an outlet of pump part 10C; and intake port 42 communicating with an inlet of pump part 10C. Seal ring 44 is attached to the tip end of the outer periphery of discharge port 40. This pump cover 38 is also secured to pump housing 20 with a fastening bolt 43 to cover pump part-accommodating portion 22.

Terminal casing 46 constituting terminal casing part 10B is fixed onto pump housing 20 at the side of electric motor part-accommodating portion 24, and terminal cover 48 is secured onto in a manner to enclose the terminal casing 46. This terminal casing part 10B is constituted of terminal casing 46 fixed to pump housing 20 and formed of synthetic resin, and terminal cover 48 formed of synthetic resin and provided to envelop a terminal-forming member (not shown but housed in the terminal casing 46 to be molded integral therewith).

In a space defined by terminal casing 46 and terminal cover 48, there is established a connection among an input terminal-forming member, a neutral terminal-forming member and the end of wire 18A wound around stator section 18 of electric motor part 10A, by fusing process. Terminal casing 46 is formed integral with connector section 50, and a part of the terminal forming members is adapted to be exposed at the connector section 50 thereby being connected with an external control device (not shown).

In electric oil pump 10, the start and the end of wire 18B wound around stator section 18 constituting electric motor part 10A are connected with the input terminal-forming and neutral terminal-forming members embedded in terminal casing 46, through a through hole formed in terminal casing 46 fixed adjacent to electric motor part-accommodating portion 24. Accordingly, a drive control signal from a control device not illustrated is supplied through the input terminal-forming member to wire 18B to rotate rotor section 16 of electric motor part 10A, thereby finally rotating pump rotor 12 to produce the pumping action.

In electric oil pump 10 combined with an automatic transmission or in a conventional electric oil pump, stator section 18 constituting an electric motor part is housed or disposed inside the end plane of the opening of electric motor part-accommodating portion 24 formed in pump housing 20, with which rotor section 16 constituting electric motor part 10A is also disposed further inside the end plane of the opening of electric motor part-accommodating portion 24 so that the center of gravity of the electric motor part 10A as a whole is to reside in the recesses of the electric motor part-accommodating portion 24, as mentioned above.

If the center of gravity of electric motor part 10A resides in the recesses of electric motor part-accommodating portion 24 of pump housing 20 as mentioned above, the distance between a plane extending along outer end surface OS of fastening bracket 51 formed in pump housing 20 and the center of gravity of electric motor part 10A residing on a line perpendicular thereto becomes increased. Consequently, in an environment (e.g. in an environment of an automotive vehicle) often causing oscillation-accompanying traveling and engine vibrations, an electric motor the center of gravity of which is far from the fixing section (or the end plane of the opening) is susceptible to the influence of the oscillations and tends to cause a phenomenon in which the rotor section in particular is shaken by the oscillations. The thus shaken rotor section brings about some malfunctions such as an abnormal wear of plain bearing 30 of driving rotational shaft 28 which connects the pump rotor to the rotor section.

The present embodiment is characterized by employing an arrangement as follows in order to prevent rotor section 16 from being shaken by oscillations.

As shown in FIG. 1, the present embodiment is configured such that stator section 18 is fastened to electric motor part-accommodating portion 24 at a location where end surface CS of stator section 18 projects outwardly to have prescribed distance L1 from the position of outer end surface OS of fastening bracket 51 (which serves as the end plane of the opening of electric motor part-accommodating portion 24) thereby bringing the center of gravity of electric motor part 10A closer to the end plane of the opening of electric motor part-accommodating portion 24. If stator section 18 is disposed outwardly in the axial direction of electric motor part-accommodating portion 24 as far as possible and rotor section 16 is moved together therewith, the center of gravity of electric motor part 10A should be moved, with which the distance between a plane extending along outer end surface OS of fastening bracket 51 formed in pump housing 20 and the center of gravity of electric motor part 10A residing on a line perpendicular thereto becomes so decreased as to reduce the ratio receiving the influence of oscillations.

By the way, stator section 18 is provided by covering the periphery of iron core 18C with bobbin 18A by resin molding. Therefore, end surface CS of stator section 18 means at least an outer peripheral surface of bobbin 18A. As shown in FIG. 1, the outer peripheral surface of bobbin 18A serves as end surface CS of stator section 18, and the end surface CS is outwardly projected from the position of outer end surface OS of fastening bracket 51 serving as the end plane of the opening of electric motor part-accommodating portion 24.

If stator section 18 is disposed further outwardly from the end plane of the opening of electric motor part-accommodating portion 24, the center of gravity of electric motor part 10A is further moved and therefore the influence of oscillations should be further reduced; however, in this arrangement it becomes necessary to move terminal casing part 10B outward. Since it is actually needed to consider the interference with other control devices in an engine compartment, stator section 18 must be fixed in electric motor part-accommodating portion 24 so that the center of gravity of electric motor part 10A is moved within a range not changing distance L2 between the surface of automatic transmission casing 26 and the tip end of terminal casing part 10B.

By moving stator section 18, it becomes possible to obtain novel arrangement, action and effect as mentioned below.

For example, by moving stator section 18 rightward in FIG. 1, rotor section 16 can also be moved rightward. It is therefore possible to increase the length of plain bearing portion 30 according thereto. Since the length of plain bearing portion 30 is thus increased, driving rotational shaft 28 can more excellently be prevented from being shaken. Furthermore, though the center of gravity of rotational mechanism including rotor section 16 of a conventional electric pump as disclosed in Patent Document 1 resides in the outside of plain bearing portion 30, plain bearing portion 30 increased in length makes it possible to capture the center of gravity of rotational mechanism within the range of plain bearing portion 30 thereby further preventing driving rotational shaft 28 from being shaken.

Incidentally, the tilt of driving rotational shaft 28 due to shake brings about malfunctions as follows. More specifically, in automotive vehicles or hybrid vehicles having an idle stop function, electric oil pump 10 is operated in the state of an internal combustion engine being stopped. At this time, there is no operating sound from the internal combustion engine, so that operating sounds of electric oil pump 10 may become displeasing to passengers in the vehicle cabin. Therefore it has been desired to reduce the operating sounds from electric oil pump 10 as much as possible.

A factor for generating the operating sound of electric oil pump 10 is derived from driving rotational shaft 28 having tilted by its shaking. Driving rotational shaft 28 is pivotally supported by cantilever plain bearing portion 30. When driving rotational shaft 28 tilts in a crevice formed between the inner peripheral surface of plain bearing portion 30 and the outer peripheral surface of driving rotational shaft 28, there arises unevenness of gap (air gap) between the stator section and the rotor section, so that magnetic flux density is made disordered to cause a harmonic content. The harmonic content increases electromagnetic force particularly in the radial direction to become a cause of oscillation, which results in the generation of noise.

According to the present embodiment, stator section 18 is fastened to electric motor part-accommodating portion 24 at a location where end surface CS of stator section 18 projects outwardly from the end plane of the opening of electric motor part-accommodating portion 24, thereby bringing the center of gravity of electric motor part 10A closer to the end plane of the opening of electric motor part-accommodating portion 24. Since the center of gravity of electric motor part 10A is brought closer to the end plane of the opening of electric motor part-accommodating portion 24, rotor section 16 becomes difficult to receive the influence of oscillations, and consequently the effect of reducing noise caused by rotor section 16 being shaken and inclined under the influence of oscillations can be expected.

As has been discussed above, the present invention is characterized in that a stator section is fastened to an electric motor part-accommodating portion at a location where the end surface of the stator section projects outwardly from the end plane of the opening of the electric motor part-accommodating portion thereby bringing the center of gravity of an electric motor part closer to the end plane of the opening of the electric motor part-accommodating portion. With this, the center of gravity of the electric motor part is brought closer to the end plane of the opening of the electric motor part-accommodating portion, and therefore a rotor section becomes difficult to receive the influence of oscillations, and consequently a phenomenon where the rotor section is shaken under the influence of oscillations can be restrained.

The present invention is not limited to the above-mentioned embodiment and involves various modifications. For example, the above-mentioned embodiment is presented only for comprehensively clearly explaining the present invention, and therefore not necessarily limited to those having all the discussed configurations. Moreover, the configurations of one embodiment may partially be substituted with those of another embodiment and it is also possible to add some configurations of one embodiment to those of another embodiment. Furthermore, for some configurations of each embodiment, it is possible to make the addition, deleting, replacement of other configurations.

The invention claimed is:

1. An electric oil pump comprising:

a pump part composed of a pump rotor accommodated in a pump part-accommodating portion formed in a metal pump housing, and an outer rotor;

an electric motor part composed of a rotor section having a permanent magnet and housed in an electric motor part-accommodating portion formed in the pump housing, and a stator section having a wire and an iron core;

a driving rotational shaft which connects the pump rotor to the rotor section and which rotates around an axis extending along a longitudinal direction of the pump;

a fastening bracket formed integrally with the pump housing and which extends radially outward from the driving rotational shaft the fastening bracket fastening the electric oil pump to an automatic transmission casing; and a pump cover including a discharge port and an intake port which communicate with the pump part, the pump cover being secured to the pump housing to cover the pump part, wherein the electric oil pump is configured to rotate the rotor section and thereby drive the pump part, an end surface of the fastening bracket defines a pane that is perpendicular to the longitudinal direction of the pump, an end surface of the stator section is protruded through the plane, in a direction away from the driving rotational shaft the driving rotational shaft has two opposite distal ends and both opposite distal ends are on a same side relative to the plane, which is opposite to a side on which the end surface of the fastening bracket is disposed, and the end surface of the fastening bracket directly contacts a terminal casing.

2. An electric oil pump as claimed in claim 1, wherein the stator section is fastened to the electric motor part-accommodating portion.

3. An electric oil pump as claimed in claim 1, wherein the electric oil pump is housed in the pump receiving section formed in an automatic transmission casing.

* * * * *